US006811745B2

(12) United States Patent
Forsberg et al.

(10) Patent No.: US 6,811,745 B2
(45) Date of Patent: Nov. 2, 2004

(54) MANUFACTURE OF ANNULAR CERMET ARTICLES

(75) Inventors: Charles W. Forsberg, Oak Ridge, TN (US); Vinod K. Sikka, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 38 days.

(21) Appl. No.: 10/345,539

(22) Filed: Jan. 16, 2003

(65) Prior Publication Data

US 2004/0141866 A1 Jul. 22, 2004

(51) Int. Cl.[7] ..... B22F 3/12
(52) U.S. Cl. ..... 419/10; 419/48
(58) Field of Search ..... 419/10, 32, 8, 419/41

(56) References Cited

U.S. PATENT DOCUMENTS 3,834,003 A * 9/1974 Nayar ..... 419/8
4,640,814 A * 2/1987 Haswell, Jr. et al. ..... 419/8
4,756,677 A * 7/1988 Hribernik et al. ..... 419/8
5,004,653 A * 4/1991 Kroisenbrunner ..... 428/615
5,006,289 A * 4/1991 Yamamoto et al. ..... 264/603
5,056,209 A * 10/1991 Ohashi et al. ..... 29/517

OTHER PUBLICATIONS

Charles W. Forsberg et al, "Depleted Uranium Dioxide–Steel Cermets for Spent–Nuclear–Fuel Multipurpose Casks," Am. Nucl. Soc., Sep. 19, 2002.

* cited by examiner

*Primary Examiner*—Daniel Jenkins
(74) *Attorney, Agent, or Firm*—Joseph A. Marasco; J. Kenneth Davis

(57) ABSTRACT

A method to produce annular-shaped, metal-clad cermet components directly produces the form and avoids multiple fabrication steps such as rolling and welding. The method includes the steps of: providing an annular hollow form with inner and outer side walls; filling the form with a particulate mixture of ceramic and metal; closing, evacuating, and hermetically sealing the form; heating the form to an appropriate temperature; and applying force to consolidate the particulate mixture into solid cermet.

8 Claims, 2 Drawing Sheets

MANUFACTURE OF ANNULAR CERMET ARTICLES

This invention was made with Government support under Contract No. DE-AC05-00OR22725 awarded by the United States Department of Energy. The Government has certain rights in the invention.

FIELD OF THE INVENTION

The present invention relates to the manufacture of metal-clad cermet articles, and more particularly to annular-shaped metal-clad cermet articles.

BACKGROUND OF THE INVENTION

Cermets consist of ceramics embedded in metals. The conventional production method produces flat or near-flat plates.

Many applications have been developed for cermets. For example, Many types of armor are made from cermets. With the proper choice of particle sizes and materials, the cement can provide high resistance to assault and accidents. All of these excellent properties follow from the fundamental characteristic of a cermet: the ability to encapsulate variable quantities of different ceramic particles into a monolithic high-integrity metal matrix. The usual problems (low thermal conductivity, low ductility) that have prevented the using of ceramicist, for example in a spent nuclear fuel (SNF) cask, are avoided by the metal matrix. Cermets are also used in some extreme applications such as brake shoes, tool bits, and nuclear fuel assemblies in some reactors.

Many types of cermets have been manufactured using a wide variety of ceramics and metals. $UO_2$-steel cermets have been manufactured and used as nuclear fuels in several research and test reactors, therefore there exists a massive experience base. The conventional process is the "picture frame" method (FIG. 1). A picture frame assembly is constructed with a bottom sheet 1 of metal and picture frame 2 of metal on top of the bottom sheet 1. For example, a mixture 3 of $UO_2$ particles and steel particles is used to fill the space where the picture would be. A sheet of steel 4 is placed over the picture frame and the pieces of steel are welded together. The entire assembly is heated to an appropriate sintering temperature and the space within the particulate mixture is vacuum degassed. The heated and evacuated picture frame assembly 5 is sent through a rolling mill 6. The combination of temperature and pressure consolidates the particles yielding $UO_2$ particles embedded in a continuous solid phase of steel. The steel particles are welded together by the rolling process to produce a metal-clad cermet plate 7.

Major difficulties have been experienced in fabricating cylindrical shells from cermets prepared by the picture frame method. Cermets are very difficult to weld and very difficult to form. This makes it very difficult to bend a flat sheet into a cylinder, weld the edge, and produce a cylindrical shell. For an application such as a SNF cask the cask walls may be 10 to 30 cm thick. This is far beyond the forming and welding technology that exists for cermet objects. Especially in thick sections, major problems are encountered in bending a flat cermet into a cylindrical form because the cermets have variable properties throughout the thickness of the material. To the present time, only partial sections of cylindrical shape (curved plates) have been manufactured, and those in thin sections.

It has long been desired to make thick-walled annular shapes such as cylinders with wall thicknesses in the range of 10 to 30 cm. Welding cermets of any thickness has always been questionable. Welding cermets of this thickness is beyond reality.

The present invention is a method to fabricate annular articles including, but not limited to, annular articles in the shape of bodies of revolution (such as cylinders, cones, etc.) and thus not requiring the rolling and welding of flat plates and the like to fabricate annular articles.

OBJECTS OF THE INVENTION

Accordingly, objects of the present invention include a metal-clad, cermet-filled, annular-shaped article which is formed by consolidating and sintering a mixture of metal powder and ceramic powder contained between an inner shell and an outer shell, thus avoiding problems associated with manufacturing flat plates of the clad cermet, and further rolling or otherwise forming and welding flat plates into annular shapes. Specifically, the construction of depleted uranium dioxide-steel cermet articles for use as casks for spent-nuclear fuel elements and the like is addressed.

Further and other objects of the present invention will become apparent from the description contained herein.

SUMMARY OF THE INVENTION

In accordance with one aspect of the present invention, the foregoing and other objects are achieved by a metal-clad, cermet-filled, annular-shaped article formed by the process steps of: providing a metallic, annular, hollow form having an inner wall and an outer wall; filling the hollow form with a particulate mixture of ceramic and metal; closing, evacuating, and hermetically sealing the form; heating the filled, evacuated, and sealed form to an appropriate sintering temperature; and applying force between the inner wall and the outer wall of the heated and evacuated, filled and sealed form to consolidate the particulate mixture into solid cermet to produce a metal-clad, cermet-filled, annular-shaped article.

In accordance with another aspect of the present invention, the foregoing and other objects are achieved by a method for making a metal-clad, cermet-filled, annular-shaped article comprises the steps of: providing a metallic, annular, hollow form having an inner wall and an outer wall; filling the hollow form with a particulate mixture of ceramic and metal; closing, evacuating, and hermetically sealing the form, heating the filled, evacuated, and sealed form to an appropriate sintering temperature; and applying force between the inner wall and the outer wall of the heated and evacuated, filled and sealed form to consolidate the particulate mixture into solid cermet to produce a metal-clad, cermet-filled, annular-shaped article.

Figure 1:
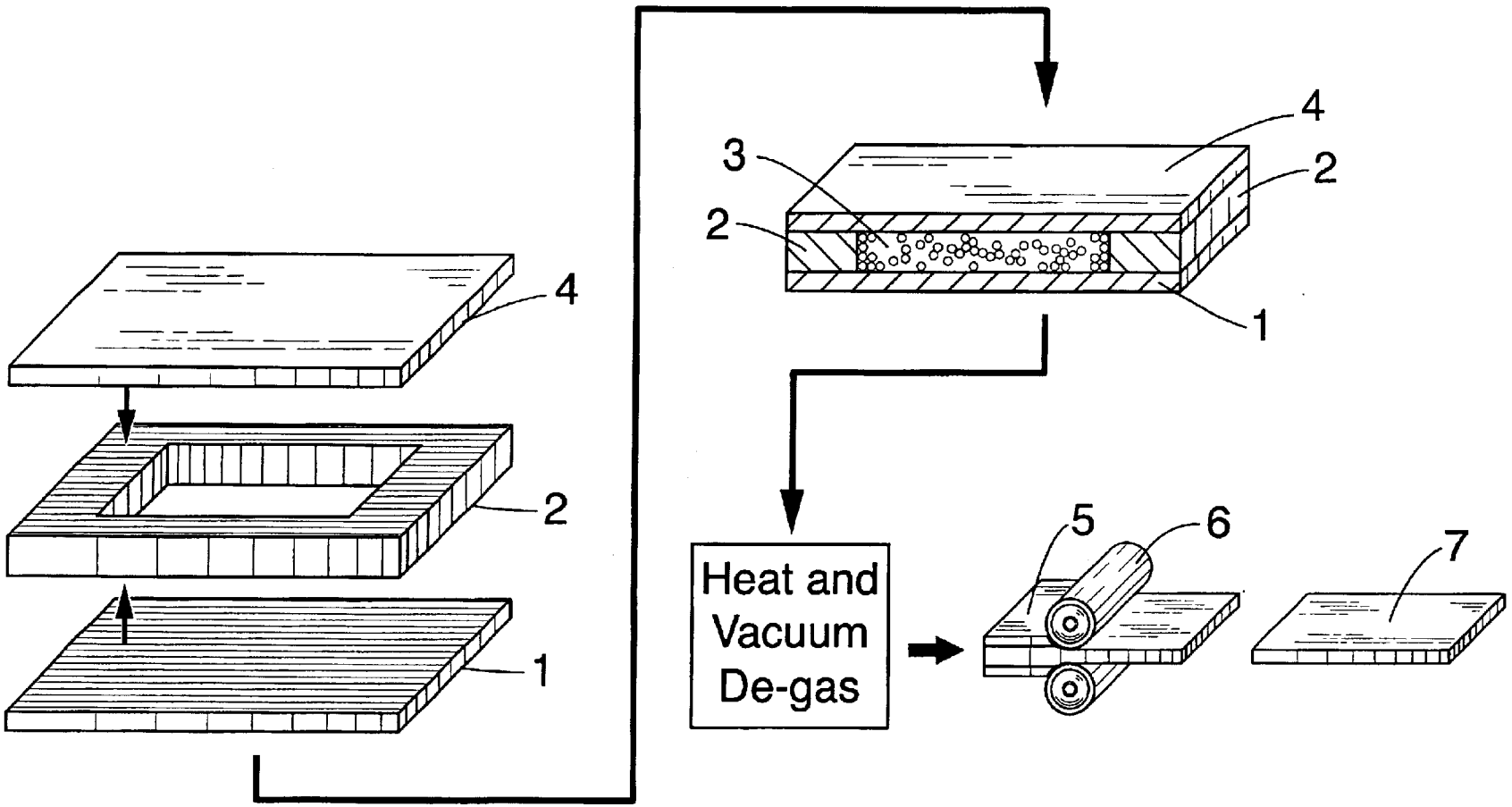
FIG. 1 is a depiction of the conventional "picture-frame" method for cermet production.
Figure 2:
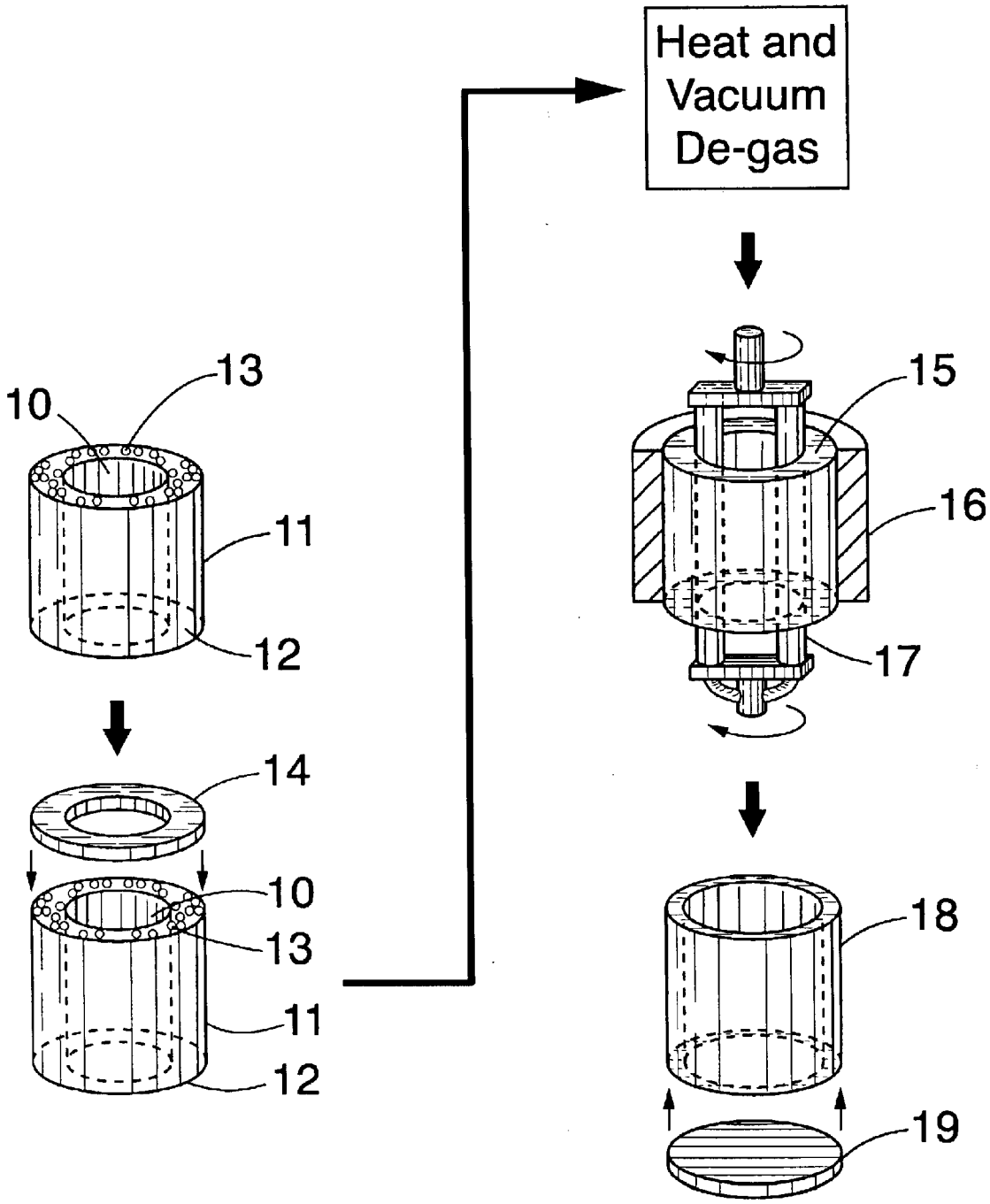
FIG. 2 is a depiction of one embodiment of the present invention showing a method for direct production of a cermet cask.

For a better understanding of the present invention, together with other and further objects, advantages and capabilities thereof reference is made to the following disclosure and appended claims in connection with the above-described drawings.

DETAILED DESCRIPTION OF THE INVENTION

The process for fabricating annular-shaped articles contains some of the same steps as the conventional "picture frame" process, but uses different steps for parts of the process. In one embodiment of the present invention, a hollow, annular container may be made of an inner shell 10 and an outer shell 11 with a bottom piece 12. The ceramic and metallic particle mixture 13 is added to the annular container until the container is full. The container is closed, in one embodiment by welding a top 14 on the annular container. After the annular container is welded shut, it is vacuum pumped (normally while being heated) to eliminate essentially all gases in the mixture 13 of ceramic and metal particles, and vacuum sealed. This filled annular container is further heated to a temperature sufficiently high to permit sintering of the metal particles. The heated and evacuated assembly 15 is then placed in or on a strong mold 16 capable of withstanding high forces. Using a process 17 such as rolling, forging, or swaging, sufficient force is applied between the inner shell and outer shell to consolidate the ceramic and metal particles between the inner and outer shells while decreasing the size of the outer shell, increasing the size of the inner shell, or both. The combination of temperature and pressure creates an annular metal-clad cermet 18 with the ceramic particles embedded in a solid, continuous phase of metal. The pressures and temperatures required for the process are similar to those required to produce a cermet of equal thickness using the conventional "picture frame" method.

By utilizing the methods of the present invention, the cermet described herein can have variable composition in three dimensions with different ceramic components such as $DUO_2$, $Al_2O_3$, etc. Although varying the composition of the cermet throughout the article may provide for improved physical and chemical properties, varying composition virtually eliminates welding techniques for joining segments to form annular shapes.

Another important characteristic of this forming technique is that the preform is close in final dimensions to the final product. With up to three-dimensional variations in the ceramic particulate/metal particulate mixture 13 and some very different properties for the various possible ceramic components, extensive forming operations with significant dimensional changes would likely create a cermet where the individual particulates are not where they began and are not where they are intended to be. However, in the method of the present invention, undesirable or uncontrolled migration of ceramic components is minimized by the minimum movement during compression of the particulate mixture into the final cermet.

Although the hot-working step is less complex when the finished clad cermet body is in the shape of a body of revolution, other, irregular shapes are possible if the apparatus and methods of rolling, forging, or swaging are cleverly designed. Such apparatus and methods are well known to the skilled artisan.

This invention enables many new types and shapes of metal-clad cermet articles including a new type of spent nuclear fuel storage, transport, and disposal cask, and also enables a skilled artisan to manufacture them. The cask walls may be constructed of a depleted uranium dioxide ($DUO_2$)-steel cermet encased in a steel jacket. This type of cermet has superior radiation shielding and repository performance characteristics. About 10,000 casks would be required in the United States and 20,000 worldwide. Each cask may weigh 50 to 100 tons with an internal diameter of 1 to 2 m, a height of 4 to 5 m, and a wall thickness of 15 to 30 cm. Because of the high oxygen content associated with the $DUO_2$, which moderates neutrons, these cermets also have better neutron shielding capabilities than steel. The cermet may also include a neutron absorber such as gadolinium oxide for efficient absorption of thermal neutrons.

After the annular shell is fabricated, a bottom piece 19 may be welded or bolted on, and a lid may be added as needed. The invention described herein provides the needed low-cost method for fabrication of the necessary annular cermet forms.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A method of making a metal-clad, cermet-filled, annular-shaped article comprising the steps of:

a. providing a metallic, annular, hollow form having an inner wall and an outer wall;

b. filling said hollow form with a particulate mixture of ceramic and metal;

c. closing, evacuating, and hermetically sealing said form;

d. heating said filled, evacuated, and sealed form to an appropriate sintering temperature;

e. placing said heated, evacuated, filled, and sealed form inside a cavity which fits the outside of said form; and f. applying force between said inner wall and said outer wall of said heated and evacuated, filled and sealed form to expand said inner wall to consolidate said particulate mixture into solid cermet to produce a metal-clad, cermet-filled annular-shaped article.

2. A method in accordance with claim 1 wherein said step of applying force is carried out using at least one moving roller.

3. A method in accordance with claim 1 wherein said step of applying force is carried out using a swaging apparatus.

4. A method in accordance with claim 1 wherein said step of applying force is carried out using a forging apparatus.

5. A method of making a metal-clad, cermet-filled, annular-shaped article comprising the steps of:

a. providing a metallic, annular, hollow form having an inner wall and an outer wall;

b. filling said hollow form with a particulate mixture of ceramic and metal;

c. closing, evacuating, and hermetically sealing said form;

d. heating said filled, evacuated, and sealed form to an appropriate sintering temperature;

e. placing said heated, evacuated, filled, and sealed form outside a cavity which fits the inside of said form; and f. applying force between said inner wall and said outer wall of said heated and evacuated, filled and sealed form to reduce said outer wall to consolidate said particulate mixture into solid cermet to produce a metal-clad, cermet-filled annular-shaped article.

6. A method in accordance with claim 5 wherein said step of applying force is carried out using at least one moving roller.

7. A method in accordance with claim 5 wherein said step of applying force is carried out using a swaging apparatus.

8. A method in accordance with claim 5 wherein said step of applying force is carried out using a forging apparatus.

* * * * *